US007183719B2

(12) United States Patent
Yang

(10) Patent No.: US 7,183,719 B2
(45) Date of Patent: Feb. 27, 2007

(54) METHOD FOR DRIVING ORGANIC LIGHT EMITTING DISPLAY PANEL

(75) Inventor: Jin-Seok Yang, Ichon-shi (KR)

(73) Assignee: Magnachip Semiconductor, Ltd. (KR)

( * ) Notice: Subject to any disclaimer, the term of this patent is extended or adjusted under 35 U.S.C. 154(b) by 0 days.

(21) Appl. No.: 10/746,113

(22) Filed: Dec. 24, 2003

(65) Prior Publication Data

US 2004/0239257 A1 Dec. 2, 2004

(30) Foreign Application Priority Data

May 31, 2003 (KR) ..... 10-2003-0035138

(51) Int. Cl.
*G09G 3/10* (2006.01)

(52) U.S. Cl. ..... 315/169.4; 345/82

(58) Field of Classification Search .. 315/169.1–169.4; 345/76–82, 55, 205, 206; 702/107, 117, 702/125

See application file for complete search history.

(56) References Cited

U.S. PATENT DOCUMENTS 6,594,606 B2 * 7/2003 Everitt ..... 702/107
6,650,308 B2 * 11/2003 Kawashima ..... 345/76
6,876,345 B2 * 4/2005 Akimoto et al. ..... 345/76
6,882,329 B2 * 4/2005 Isono et al. ..... 345/69

* cited by examiner

*Primary Examiner*—Wilson Lee
(74) *Attorney, Agent, or Firm*—Blakely Sokoloff Taylor & Zafman

(57) ABSTRACT

A method for driving an organic light emitting display panel including a plurality of organic light emitting diode which are coupled to a plurality of segment lines and a plurality of common lines in a matrix structure comprises the steps of: (A) precharging a first organic light emitting diode connected to a first common line and a second organic light emitting diode connected to a second common line, wherein the first common line neighbors on the second common line; (B) supplying a first driving current to the first organic light emitting diode; (C) supplying a second driving current to the second organic light emitting diode; and (D) discharging electrified charge of the first and second organic light emitting diodes.

7 Claims, 8 Drawing Sheets

METHOD FOR DRIVING ORGANIC LIGHT EMITTING DISPLAY PANEL

FIELD OF INVENTION

The present invention relates to a method for driving a display panel; and, more particularly, to a method for driving an organic light emitting display panel.

DESCRIPTION OF PRIOR ART

Generally, a flat panel display (FPD) is classified into an inorganic device and an organic device in according to a display material of the flat panel display. In the inorganic device, there are a plasma display panel (PDP), a field emission display (FED), and the like. The PDP is operated by using a photo luminescence PL emitted from a fluorescent substance, and the FED is operated by using a cathode luminescence. Meanwhile, in the organic device, there are a liquid crystal display (LCD), an organic light emitting display (OLED), and the like.

The organic light emitting display (hereinafter, referred as an OLED) is in the spotlight because of an operating speed. The operation speed of the OLED is faster thirty thousand times than that of the liquid crystal display LCD which is used commonly. In addition, the OLED has the advantage of supporting a wide view and a high brightness, as including a material which can emit light by itself.

FIG. 1 is a block diagram describing a conventional organic light emitting display.

As shown, the OLED includes an OEL panel having a plurality of unit pixels and a driver for driving the plurality of unit pixels through a plurality of segment lines and common lines. The plurality of unit pixels is coupled to each other in a matrix structure defined by the plurality of segment lines and common lines. That is, in the OEL panel, a column line is referred as the segment line and a row line is referred as the common line.

FIG. 2 is a schematic circuit diagram showing a part of the OEL panel shown in FIG. 1.

As shown, each unit pixel includes an organic light emitting diode and a capacitor. One side of the organic light emitting diode and the capacitor is connected to the segment line., and the other side of the organic light emitting diode and the capacitor is connected to the common line.

FIG. 3 is a schematic circuit diagram depicting a unit pixel 10 of the OEL panel and a unit driver 100 of the driver for controlling the unit pixel 10.

As shown, the unit pixel 10 includes an organic light emitting diode $D_p$ and a capacitor $C_p$. Herein, the capacitor $C_p$ is used for supplying a predetermined voltage between each side of the organic light emitting diode $D_p$. A plus terminal of the organic light emitting diode $D_p$ is connected to the segment line and a minus terminal of the organic light emitting diode $D_p$ is connected to the common line.

The unit driver 100 is provided with a first current source 20, a second current source 30, a first MOS transistor M1, a second MOS transistor M2 and a third MOS transistor M3. The first current source 20 is used for supplying a precharge current to the organic light emitting diode $D_p$ through the segment line. The second current source 30 supplies a driving current to the organic light emitting diode $D_p$ through the segment line. The first MOS transistor M1 connects or disconnects the first current source 20 to the segment line in response to a precharge on/off signal. Similarly, the second MOS transistor M2 connects or disconnects the second current source 30 to the segment line in response to a driving on/off signal. The third MOS transistor M3 controlled by a discharge on/off signal for selectively discharging charges stored in the capacitor $C_p$ to a ground voltage VSS. Namely, each of the first to third MOS transistors M1 to M3 is served as a switch. Herein, the unit driver 100 is coupled to the unit pixel 10 through a first pad 50. A second pad 40 in FIG. 1 receives a voltage supplied to the common line.

FIG. 4 is a timing diagram demonstrating operation of the unit driver 100 shown in FIG. 3. And, FIGS. 5A to 5D are equivalent circuit diagrams describing the unit driver 100 and the unit pixel 10 during each period shown in FIG. 4.

Referring to FIG. 4, the operation of the unit driver 100 includes a null step, a precharge step, a driving step and a discharge step. FIGS. 5A to 5D describe equivalent circuits during a null period, a precharge period, a driving period and a discharge period, respectively. Hereinafter, referring to FIGS. 1 to 5D, the operation of the organic light emitting display is described in detail.

In FIGS. 5A to 5B, a colon capacitor 10' beside the unit pixel 10 means a load capacitance generated by surround unit pixels when the driving current is supplied to the unit pixel 10. In addition, the first to third MOS transistors are referred as a first to third switches S1 to S3 in the equivalent circuits.

First, referring to FIG. 5A, the null step during the null period is described. The first to third switches S1 to S3 are turned off; and a common voltage VDC which is commonly supplied to each unit pixel is supplied to the minus terminal of the organic light emitting diode $D_p$.

Next, referring to FIG. 5B, the first switch S1 is turned on and the second and third switches S2 and S3 are turned off in the precharge step during the precharge period. As a result, the precharge current is supplied to the unit pixel 10 from the first current source 20. The precharge step is used for supplying a current until a voltage supplied between two terminals of the organic light emitting diode $D_p$ is equivalent to a threshold voltage Vth of the organic light emitting diode $D_p$ before the driving period.

If there is no precharge step in the operation of the organic light emitting display, at the driving step, the driving voltage, which makes the organic light emitting diode $D_p$ emit light in the driving step, is directly supplied to the organic light emitting diode $D_p$. Then, some of the driving voltage is used as the threshold voltage Vth of the organic light emitting diode $D_p$ for turning the same on. Thus, if the voltage supplied between the two terminals of the organic light emitting diode $D_p$ is equivalent to a threshold voltage Vth of the organic light emitting diode $D_p$ before the driving period, the driving voltage used in the driving period can be effectively decreased.

The organic light emitting diode $D_p$ emits light when the organic light emitting diode $D_p$ receives a current above a predetermined level. That is, the voltage drop across the organic light emitting diode $D_p$ keeps above the threshold voltage Vth of the organic light emitting diode $D_p$ in order to obtain light emitted from the organic light emitting diode $D_p$ corresponding with a supplied current. It is because each capacitor $C_p$ in each unit pixel has the characteristic with protecting a flow of a direct current DC.

Therefore, in order to obtain all scales which the organic light emitting diode $D_p$ can present, the precharge step is performed before the driving period.

Next, referring to FIG. 5C, the second switch S2 is turned on and the first and third switches S1 and S3 are turned off at the driving step. As a result, the driving current outputted from the second current source 30 is supplied to the unit pixel 10. Then, the organic light emitting diode $D_p$ emits light in response to the driving current.

Next, referring to FIG. 5D, the third switch S3 is turned on and the first and second switches S1 and S2 are turned off at the discharge step. As a result, the charge stored in the unit pixel 10 is discharged by the ground voltage VSS.

After the discharge period, the four steps, i.e., the null step, the precharge step, the driving step and the discharge step is sequentially repeated.

FIG. 6A is a waveform describing a method of driving a panel of the conventional organic light emitting display. As shown, there is depicted the operation of the panel including the plurality of unit pixels in a matrix structure.

In the panel of the conventional organic light emitting display, the unit pixels which are connected to one common line simultaneously emit light. As above statement, the operation of emitting light includes the four steps, i.e., the null step, the precharge step, the driving step and the discharge step.

As shown, the four steps are performed in a first common line selected by a common line selecting signal. And then, in a second common line selected by the common line selecting signal, the four steps are carried out. Herein, the organic light emitting diode $D_p$ may emit light during the driving and discharge periods.

Amount of the light emitted from the organic light emitting diode $D_p$ is defined based on amount of the driving current supplied to the organic light emitting diode $D_p$. There are two methods, a pulse width modulation PWM and a pulse amplitude modulation PAM as shown in FIG. 6B, for supplying the driving current to the organic light emitting diode $D_p$.

Referring to A, B, C and D in FIG. 6B, as the PWM, the driving current supplied to the unit pixel has a different pulse width in response to amount of emitted light. Namely, the emitted light is determined by the pulse width of the driving current.

In the other hand, as the PAM (referred to E, F, G and H in FIG. 6B), the driving current supplied to the unit pixel has a different pulse amplitude in response to amount of emitted light. Namely, the emitted light is determined by the pulse amplitude of the driving current.

As above statement, for emitting the light from the panel of the organic light emitting display, there are the four steps, i.e., the null step, the precharge step, the driving step and the discharge step at each common line. However, the above method has the disadvantage of consuming a large power. Particularly, amount of the precharge current used for each precharge period is much larger than amount of the driving current used for each driving period. As a result, there is a serious problem that the precharge step for precharging unit pixels in each common line should be performed to thereby consuming a large amount of precharge current.

SUMMARY OF INVENTION

It is, therefore, an object of the present invention to provide a method for driving an organic light emitting display panel as effectively reducing an operation current.

In accordance with an aspect of the present invention, there is provided a method for driving an organic light emitting display panel including a plurality of organic light emitting diode which are coupled to a plurality of segment lines and a plurality of common lines in a matrix structure comprises the steps of: (A) precharging a first organic light emitting diode connected to a first common line and a second organic light emitting diode connected to a second common line, wherein the first common line neighbors on the second common line; (B) supplying a first driving current to the first organic light emitting diode; (C) supplying a second driving current to the second organic light emitting diode; and (D) discharging electrified charge of the first and second organic light emitting diodes.

In accordance with an aspect of the present invention, there is provided a method for driving an organic light emitting display panel including a plurality of organic light emitting diode which are coupled to a plurality of segment lines and a plurality of common lines in a matrix structure, comprising the steps of: (S) simultaneously precharging at least one organic light emitting diodes connected to at least one common lines; (T) sequentially supplying each driving current to organic light emitting diodes connected to each common line; and (U) simultaneously discharging electrified charge of at least one organic light emitting diodes connected to at least one common lines.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF INVENTION

Hereinafter, a method for driving a panel of an organic light emitting display will be described in detail with reference to the accompanying drawings.

Figure 1:
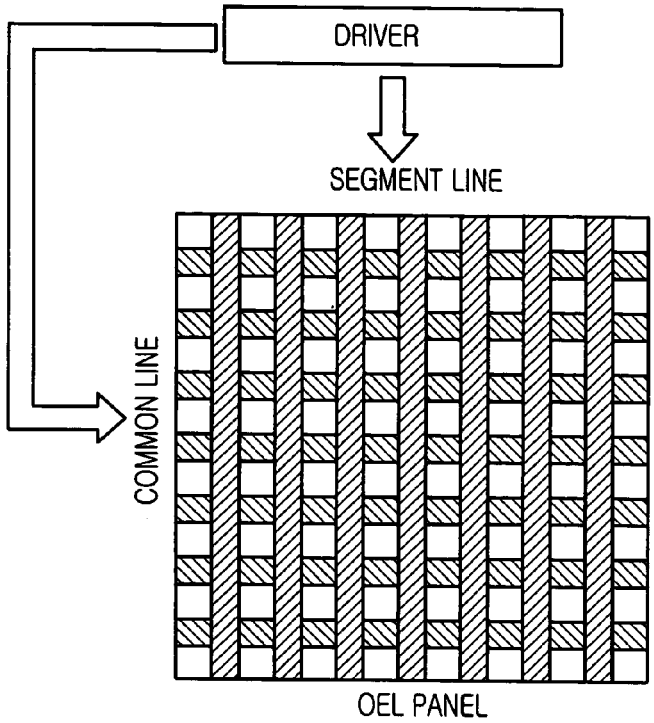
FIG. 1 (PRIOR ART)
FIG. 1 is a block diagram describing a conventional organic light emitting display (OEL) in outline.
Figure 2:
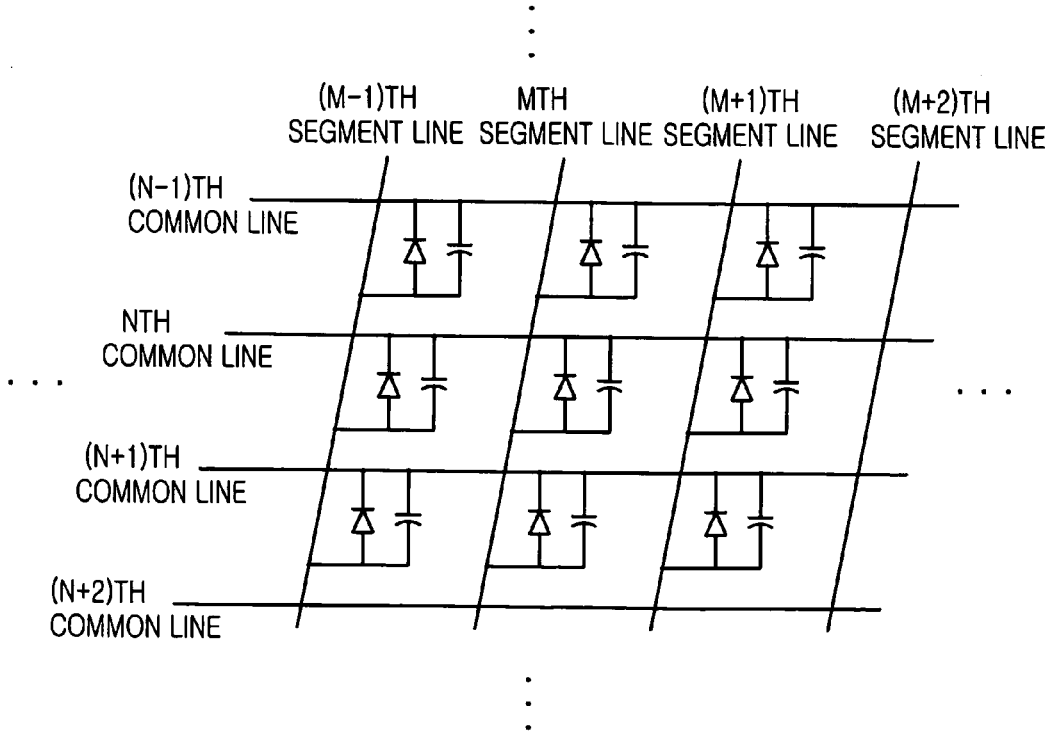
FIG. 2 (PRIOR ART)
FIG. 2 is a schematic circuit diagram showing a part of an OEL panel shown in FIG. 1.
Figure 3:
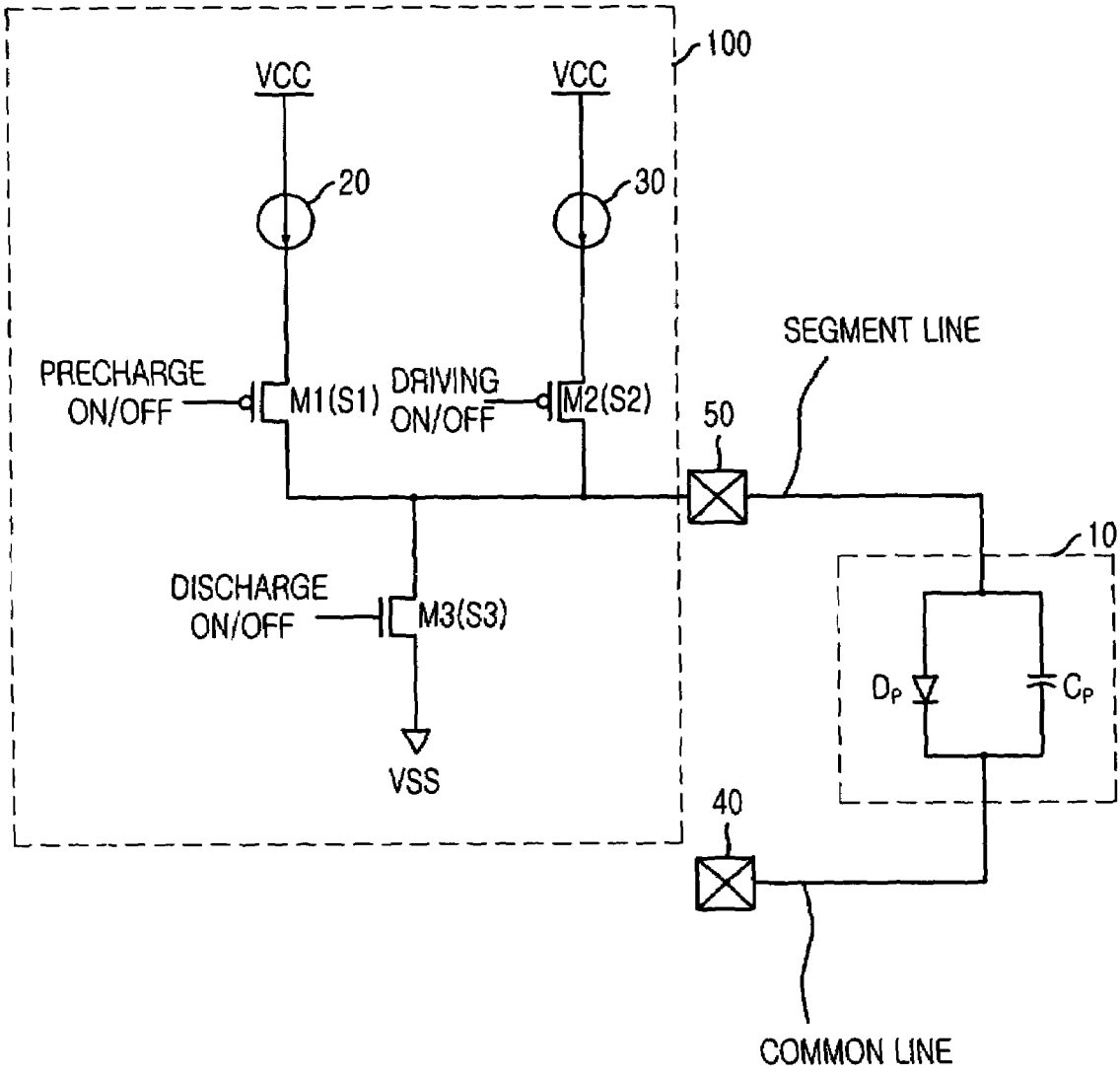
FIG. 3 (PRIOR ART)
FIG. 3 is a schematic circuit diagram depicting a unit pixel of the OEL panel and a unit driver of a driver for controlling the unit pixel.
Figure 4:
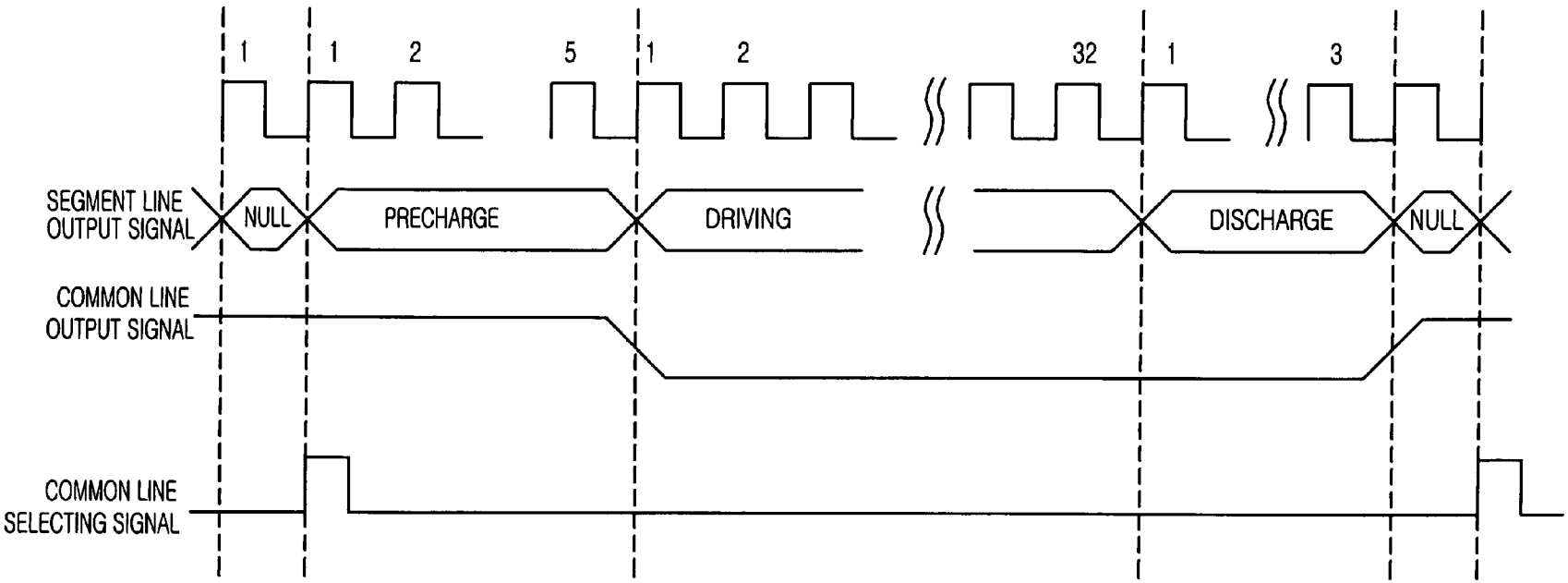
FIG. 4 (PRIOR ART)
FIG. 4 is a timing diagram demonstrating operation of the unit driver shown in FIG. 3.
Figure 5A:
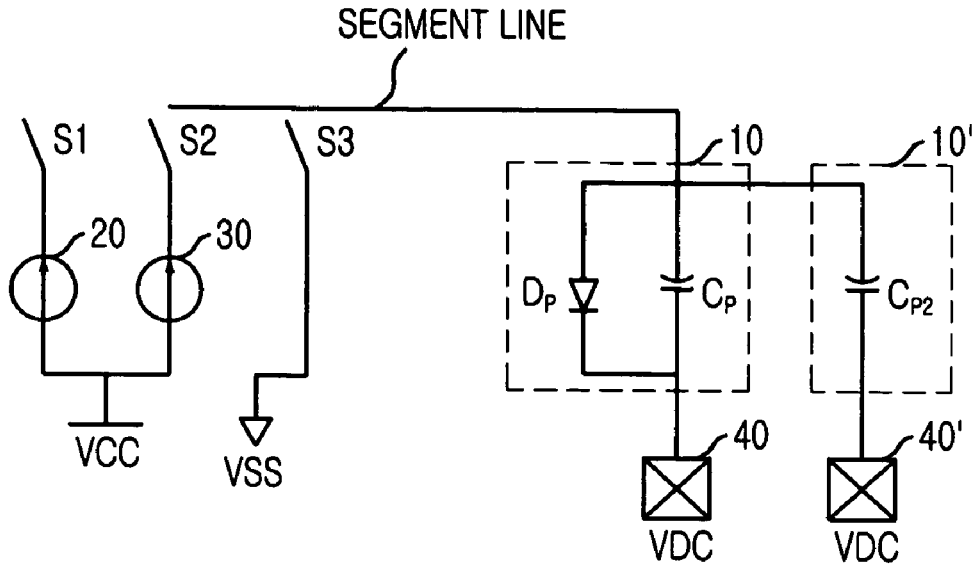
FIG. 5A (PRIOR ART)
FIG. 5A is an equivalent circuit diagram describing the unit driver and the unit pixel shown in FIG. 3 during a null period.
Figure 5B:
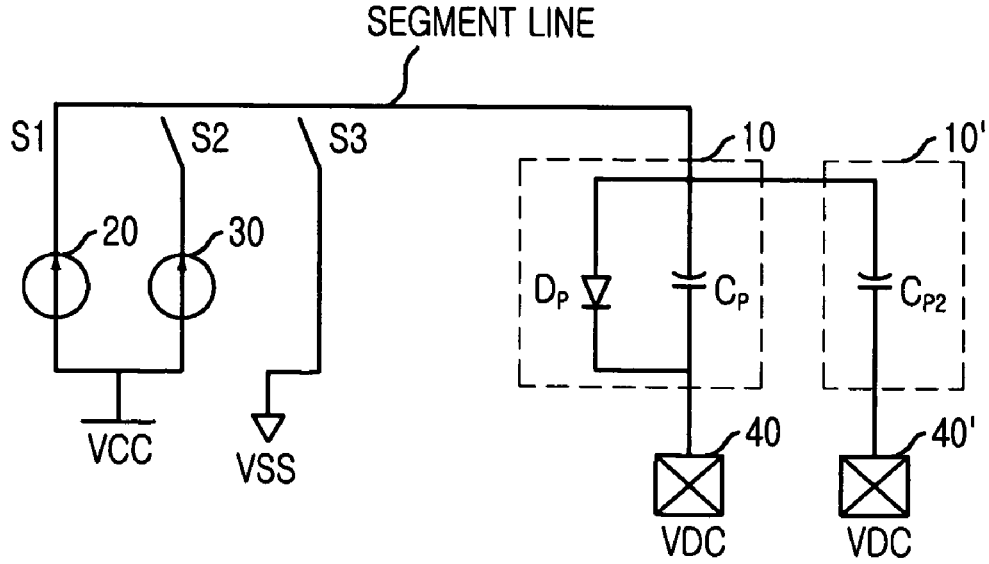
FIG. 5B (PRIOR ART)
FIG. 5B is an equivalent circuit diagram describing the unit driver and the unit pixel shown in FIG. 3 during a percharge period.
Figure 5C:
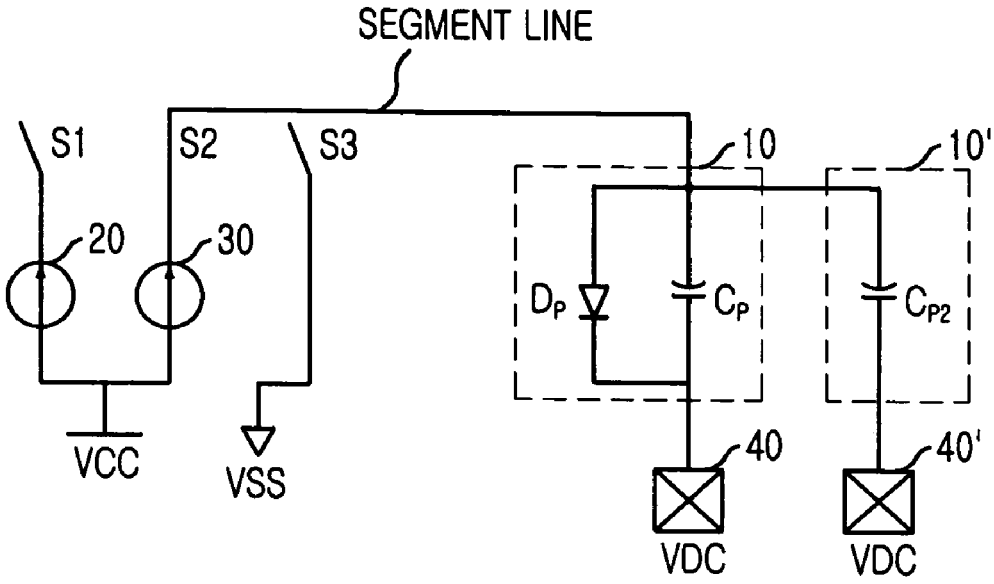
FIG. 5C (PRIOR ART)
FIG. 5C is an equivalent circuit diagram describing the unit driver and the unit pixel shown in FIG. 3 during a driving period.
Figure 5D:
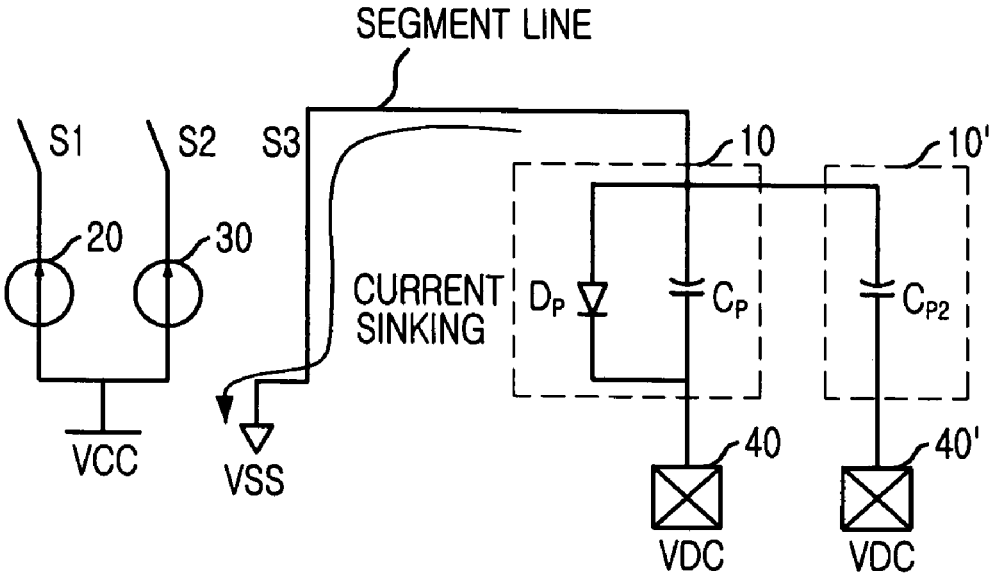
FIG. 5D (PRIOR ART)
FIG. 5D is an equivalent circuit diagram describing the unit driver and the unit pixel shown in FIG. 3 during a discharge period.
Figure 6A:
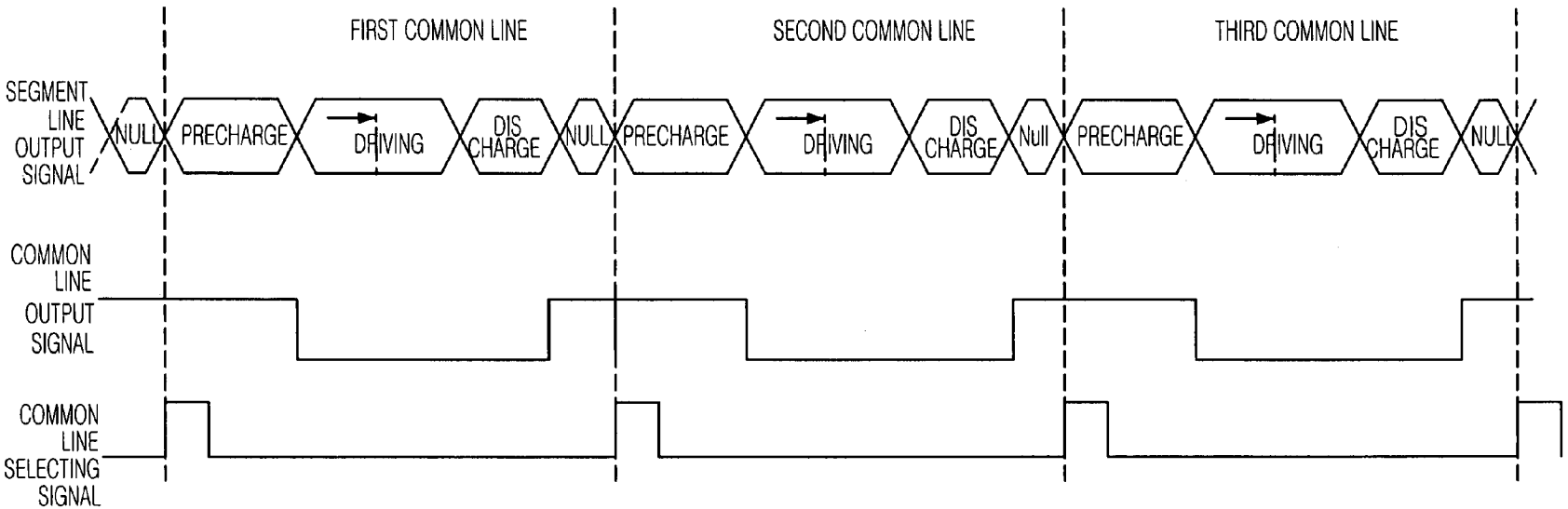
FIG. 6A (PRIOR ART)
FIG. 6A is a waveform describing a method of driving a panel of the conventional organic light emitting display.
Figure 6B:
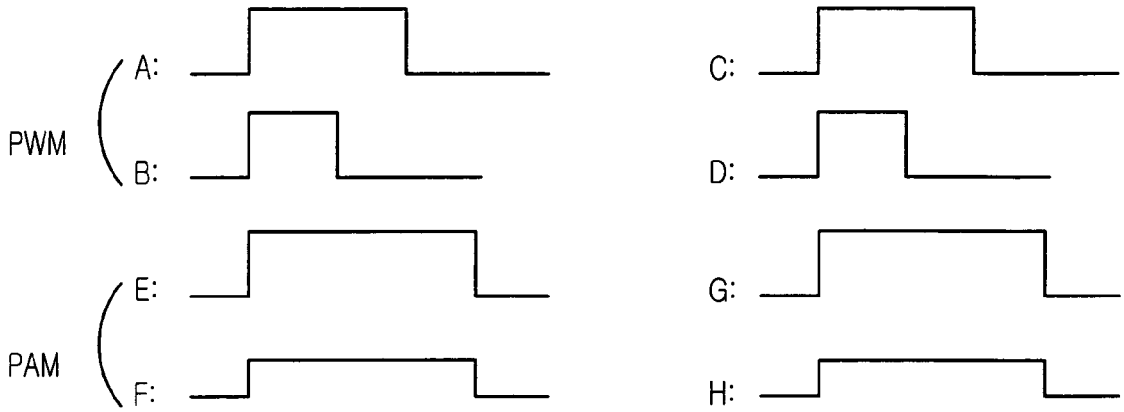
FIG. 6B (PRIOR ART)
FIG. 6B describes a pulse width modulation PWM and a pulse amplitude modulation PAM.
Figure 7:
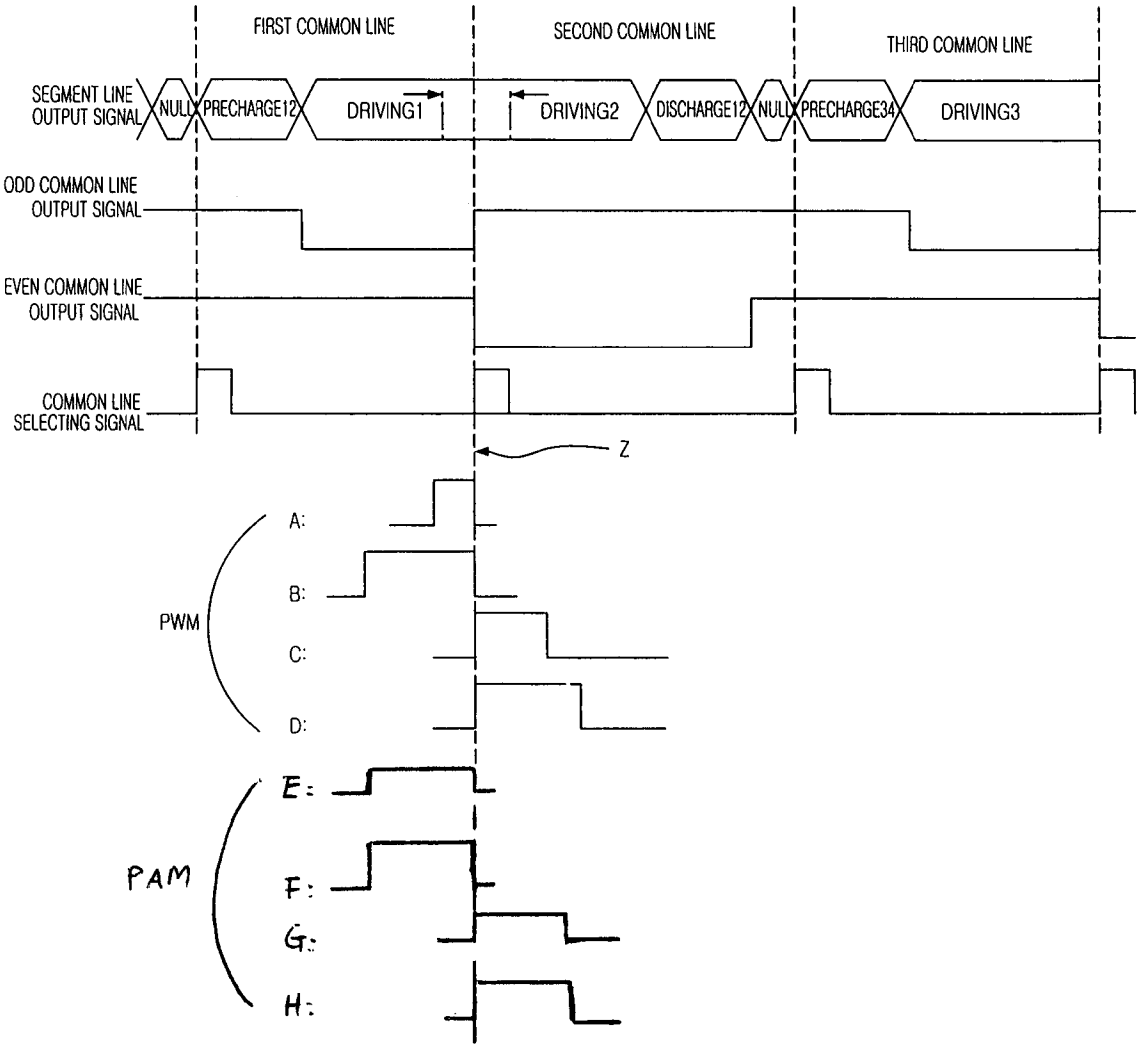
FIG. 7 is a waveform describing a method of driving a panel of an organic light emitting display in accordance with the present invention.

FIG. 7 is a waveform describing a method of driving an organic light emitting display panel in accordance with the present invention.

As shown, the method for driving the organic light emitting display panel including a plurality of organic light emitting diode which are coupled to a plurality of segment lines and a plurality of common lines includes four steps.

First of all, in a first precharge period PRECHARGE12, there are precharged a first organic light emitting diode connected to a first common line and a second organic light emitting diode connected to a second common line, wherein the first common line neighbors on the second common line.

Next, in a first driving period DRIVING1, a first driving current is supplied to the first organic light emitting diode; and in a second driving period DRIVING2, a second driving current is supplied to the second organic light emitting diode. Herein, the first and second organic light emitting diodes emit light in response to the first and second driving current.

Then, in a first discharge period DISCHRGE12, an electrified charge of the first and second organic light emitting diodes is discharged.

After above four steps, same four steps are carried out on next two common lines, e.g., a third and a fourth common lines. Namely, in a second precharge period PRECHARGE34, there are precharged a third organic light emitting diode connected to the third common line and a forth organic light emitting diode connected to the forth common line, wherein the third common line neighbors on the forth common line. Next, in a third driving period DRIVING3, a third driving current is supplied to a third organic light emitting diode connected to the third common line.

As not shown, in a forth driving period, a forth driving current is supplied to a forth organic light emitting diode connected to the forth common line. Then, in a second discharge period, an electrified charge of the third and forth organic light emitting diodes is discharged.

Herein, there are needed an odd common line output signal and an even common line output signal for separating the second driving period from the first driving period or the forth driving period from the third driving period. As shown, the odd common line output signal and the even common line output signal are activated as a logic low level. Namely, for supplying the first driving current to the first organic light emitting diode, the odd common line output signal is inactivated after the first precharge period PRECHARGE12. Likewise, the odd common line output signal is in the logic low level for supplying the third driving current to the third organic light emitting diode. Otherwise, for supplying the second or the forth driving current to the second or the forth organic light emitting diode, the even common line output signal is in the logic low level.

Therefore, in the present invention, operations of precharging and discharging a common line are simultaneously performed on two neighboring common lines and an operation of driving a common line is respectively carried out on each of the two neighboring common lines.

The method of driving the panel in accordance with the present invention can effectively reduce consummated current occurred at the operation of precharging the common line.

Meanwhile, there are two manners, i.e., a pulse width modulation (PWM) and a pulse altitude modulation (PAM) for supplying the first or second driving current to the first or second organic light emitting diode.

As above statement, the PWM supplies a driving current having a different pulse width to the unit pixel, and the PAM supplies a driving current having a different pulse amplitude to the unit pixel. Namely, in the PWM, the emitted light is determined by the pulse width of the driving current; otherwise, in the PAM, the emitted light is determined by the pulse amplitude of the driving current.

Herein, when the PWM is applied, there can be a problem that the electrified charge of the first and second organic light emitting diodes is discharged if the second driving current is not directly supplied to the second organic light emitting diode after the first driving current is supplied to the first organic light emitting diode. So, like 'Z' point as shown in FIG. 7, a falling edge of the first driving current are coincided with a rising edge of the second driving current.

In detail, as shown, for driving the first organic light emitting diode, the first driving current, e.g., A or B is supplied during the first driving period DRIVING1. Likewise, the second driving current, e.g., C or D is supplied during the second driving period DRIVING2. As a result, the falling edge of the first driving current are concurred with the rising edge of the second driving current.

When the PAM is applied to driving the panel, it is easy to concur the falling edge of the first driving current (e.g., E or F) with the rising edge of the second driving current (e.g., G or H) because the pulse width of the driving current is fixed, e.g., the pulse width of the first driving current is equivalent to the first driving period DRIVING1.

For protecting a deterioration of the organic light emitting diode, there is the step of discharging the charge stored in the first and second organic light emitting diodes in the method for driving the organic light emitting display panel.

In above statement, there is described the case that the precharging or discharging steps are carried out on two neighboring common lines. Namely, a power for precharging the common line is supplied by twos, not at each precharge step of each common line. Thus, amount of the power for prechaging the common line is decreased. There is efficiently reduced the power for driving the organic light emitting display panel, because amount of current for precharing the common line is more larger than that for driving the common line. However, to the extent that capability and characteristic of the organic light emitting diode is not deteriorated, a plurality of common lines can be simultaneously precharged or discharged.

As the precharging or discharging steps of the method for driving the organic light emitting display panel is simultaneously performed on a predetermined number of common lines, the present invention can gradually reduce the power consumption for driving the organic light emitting display panel.

While the present invention has been described with respect to the particular embodiments, it will be apparent to those skilled in the art that various changes and modifications may be made without departing from the spirit and scope of the invention as defined in the following claims.

What is claimed is:

1. A method for driving an organic light emitting display panel including a plurality of organic light emitting diode which are coupled to a plurality of segment lines and a plurality of common lines in a matrix structure, comprising the steps of:

precharging both a first organic light emitting diode connected to a first common line and a second organic light emitting diode connected to a second common line at once, wherein the first common line neighbors on the second common line;

supplying a first driving current to the first organic light emitting diode;

supplying a second driving current to the second organic light emitting diode without additionally precharging the second organic light emitting diode before supplying the second driving current; and discharging electrified charge of both the first and second organic light emitting diodes.

2. The method as recited in claim 1, wherein the supplying a first driving current step includes the steps of:

outputting a first control signal for driving the first organic light emitting diode; and supplying the first driving current to the first organic light emitting diode in response to the first control signal.

3. The method as recited in claim 2, wherein the supplying a second driving current step includes the steps of:

outputting a second control signal for driving the second organic light emitting diode; and supplying the second driving current to the second organic light emitting diode in response to the second control signal.

4. The method as recited in claim 3, wherein the first control signal is inactivated at the simultaneous timing of activating the second control signal.

5. The method as recited in claim 4, wherein the first and second driving current is supplied by an alternative method selected one of group consisting of a pulse width modulation (PWM) and a pulse amplitude modulation (PAM).

6. A method for driving an organic light emitting display panel including a plurality of organic light emitting diode which are coupled to a plurality of segment lines and a plurality of common lines in a matrix structure, comprising the steps of:

simultaneously precharging at least two organic light emitting diodes connected to at least one common lines;

sequentially supplying a driving current to each of the two organic light emitting diodes connected to each common line without additionally precharging either organic light emitting diode before supplying a next driving current; and simultaneously discharging electrified charge of at least two organic light emitting diodes connected to at least one common lines.

7. The method as recited in claim 6, wherein the driving current is supplied by an alternative method selected one of group consisting of a pulse width modulation (PWM) and a pulse amplitude modulation (PAM).

* * * * *